US011035600B2

(12) United States Patent
Lindberg et al.

(10) Patent No.: US 11,035,600 B2
(45) Date of Patent: Jun. 15, 2021

(54) CAPACITY CONTROL FOR CHILLERS HAVING SCREW COMPRESSORS

(71) Applicant: Johnson Controls Technology Company, Auburn Hills, MI (US)

(72) Inventors: Gail E. Lindberg, Spring Grove, PA (US); Curtis C. Crane, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 218 days.

(21) Appl. No.: 16/312,929

(22) PCT Filed: Jun. 1, 2017

(86) PCT No.: PCT/US2017/035511
§ 371 (c)(1),
(2) Date: Dec. 21, 2018

(87) PCT Pub. No.: WO2018/004985
PCT Pub. Date: Jan. 4, 2018

(65) Prior Publication Data

US 2019/0249666 A1 Aug. 15, 2019

Related U.S. Application Data

(60) Provisional application No. 62/355,216, filed on Jun. 27, 2016.

(51) Int. Cl.
*F25B 49/02* (2006.01)
*F04C 18/16* (2006.01)
(Continued)

(52) U.S. Cl.
CPC ..... *F25B 49/022* (2013.01); *F04C 18/16* (2013.01); *F04C 28/12* (2013.01); *F04C 2210/22* (2013.01);
(Continued)

(58) Field of Classification Search
CPC ..... F04C 28/12; F04C 28/125; F25B 49/022; F25B 2600/026; F25B 2700/21171
See application file for complete search history.

(56) References Cited

U.S. PATENT DOCUMENTS 3,088,656 A * 5/1963 Hartley ..... F04B 49/00 417/274
3,408,827 A * 11/1968 Soumerai ..... F25B 43/02 62/196.1
(Continued)

FOREIGN PATENT DOCUMENTS

CN 1176680 A 3/1998
CN 101403383 A 4/2009
(Continued)

OTHER PUBLICATIONS

Office Action on CN 201780038931.2, dated Sep. 27, 2019, 9 pages.
(Continued)

*Primary Examiner* — Jonathan Bradford
(74) *Attorney, Agent, or Firm* — Fletcher Yoder, P.C.

(57) ABSTRACT

A compressor system includes a screw compressor and a controller. The screw compressor includes a slide valve selectively actuatable between a first position and a second position to facilitate modulating a capacity of the screw compressor between fully-loaded and fully-unloaded. The controller is communicably coupled to the slide valve. The controller is configured to receive a chilled fluid temperature setpoint for a fluid in heat transfer communication with a refrigerant of the refrigeration circuit; receive temperature data indicative of a chilled fluid temperature of the fluid; determine a difference between the chilled fluid temperature and the chilled fluid temperature setpoint; and provide one of a load command and an unload command to the slide valve based the difference between the chilled fluid temperature and the chilled fluid temperature setpoint. Accord-
(Continued)

ing to an embodiment, the controller does not receive feedback from the screw compressor regarding a position of the slide valve.

15 Claims, 7 Drawing Sheets

(51) Int. Cl.
*F25B 1/047* (2006.01)
*F04C 28/12* (2006.01)

(52) U.S. Cl.
CPC .. *F04C 2270/015* (2013.01); *F04C 2270/195* (2013.01); *F04C 2270/585* (2013.01); *F25B 1/047* (2013.01); *F25B 2339/041* (2013.01); *F25B 2600/026* (2013.01); *F25B 2700/21171* (2013.01)

(56) References Cited

U.S. PATENT DOCUMENTS 4,538,421 A 9/1985 Kawamoto
5,027,608 A 7/1991 Rentmeester et al.
5,295,632 A * 3/1994 Zink ..... B65D 5/0055 229/117.16
2015/0292762 A1 10/2015 Clanin et al.

FOREIGN PATENT DOCUMENTS

CN 101600884 A 12/2009
CN 102193567 A 9/2011
GB 2 077 951 12/1981
WO WO-2007/106090 A1 9/2007

OTHER PUBLICATIONS

Office Action on Taiwan Patent Application No. 106120414 dated Jan. 22, 2018. 6 pages.
Rejection Decision in Taiwanese Patent Application No. 106120414 dated Aug. 30, 2018. 7 pages.
Search Report on Taiwan Patent Application No. 106120414 dated Jan. 22, 2018. 2 pages.
Search Report for International Application No. PCT/US2017/035511, dated Aug. 2, 2017, 16 pages.

* cited by examiner

CAPACITY CONTROL FOR CHILLERS HAVING SCREW COMPRESSORS

CROSS-REFERENCE TO RELATED PATENT APPLICATIONS

This application is a U.S. National Stage Application of PCT/US2017/035511, filed Jun. 1, 2017, which claims the benefit of U.S. Provisional Patent Application No. 62/355,216, filed Jun. 27, 2016, both of which are incorporated herein by reference in their entirety.

BACKGROUND

The present disclosure relates generally to the field of compressor systems for refrigeration circuits and the control thereof. More specifically, the present disclosure relates to the control of compressor systems having screw compressors.

Screw compressors typically include two meshing helical screws or rotors configured to compress a gas. The gas enters at a suction side of the screw compressors and moves through meshing threads of the screws as the screws rotate. The meshing threads force the gas through the compressor, and the gas exits at the end of the screws with an increased temperature and pressure.

SUMMARY

One implementation of the present disclosure is related to a compressor system for a refrigeration circuit. The compressor system includes a screw compressor and a controller. The screw compressor includes a slide valve selectively actuatable between a first position and a second position to facilitate modulating a capacity of the screw compressor between fully-loaded and fully-unloaded. The controller is communicably coupled to the slide valve. The controller is configured to receive a chilled fluid temperature setpoint for a fluid in heat transfer communication with a refrigerant of the refrigeration circuit, receive temperature data indicative of a chilled fluid temperature of the fluid, determine a difference between the chilled fluid temperature and the chilled fluid temperature setpoint, and provide one of a load command and an unload command to the slide valve based the difference between the chilled fluid temperature and the chilled fluid temperature setpoint. According to an example embodiment, the controller does not receive feedback from the screw compressor regarding a position of the slide valve.

Another implementation of the present disclosure is related to a method for capacity control of a chiller having a compressor. The method includes receiving, by a processing circuit, a chilled fluid temperature setpoint for a fluid in heat transfer communication with a refrigerant of the chiller; receiving, by the processing circuit, temperature data from a temperature sensor indicative of a chilled fluid temperature of the fluid; providing, by the processing circuit, a load command to a slide valve of the compressor to increase the capacity of the compressor in response to the chilled fluid temperature being greater than the chilled fluid temperature setpoint; and providing, by the processing circuit, an unload command to the slide valve to decrease the capacity of the compressor in response to the chilled fluid temperature being less than the chilled fluid temperature setpoint. According to an example embodiment, the processing circuit does not receive feedback from the compressor regarding a position of the slide valve.

Still another implementation of the present disclosure is related to a chiller. The chiller includes a compressor, a condenser positioned downstream of the compressor, an expansion valve positioned downstream of the condenser, an evaporator positioned downstream of the expansion valve and upstream of the compressor, and a controller. The compressor is configured to provide a refrigerant throughout the chiller. The compressor has a slide valve that is selectively actuatable to facilitate modulating a capacity of the compressor. The evaporator is configured to subject the refrigerant to a heat exchange relationship with a fluid. The controller is configured to receive a temperature setpoint for the fluid in heat transfer communication with the refrigerant, receive temperature data indicative of a temperature of the fluid, provide a load command to the slide valve of the compressor to increase the capacity of the compressor in response to the temperature of the fluid being greater than the temperature setpoint, and provide an unload command to the slide valve to decrease the capacity of the compressor in response to the temperature of the fluid being less than the temperature setpoint. According to an example embodiment, the controller does not receive feedback from the compressor regarding a position of the slide valve.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
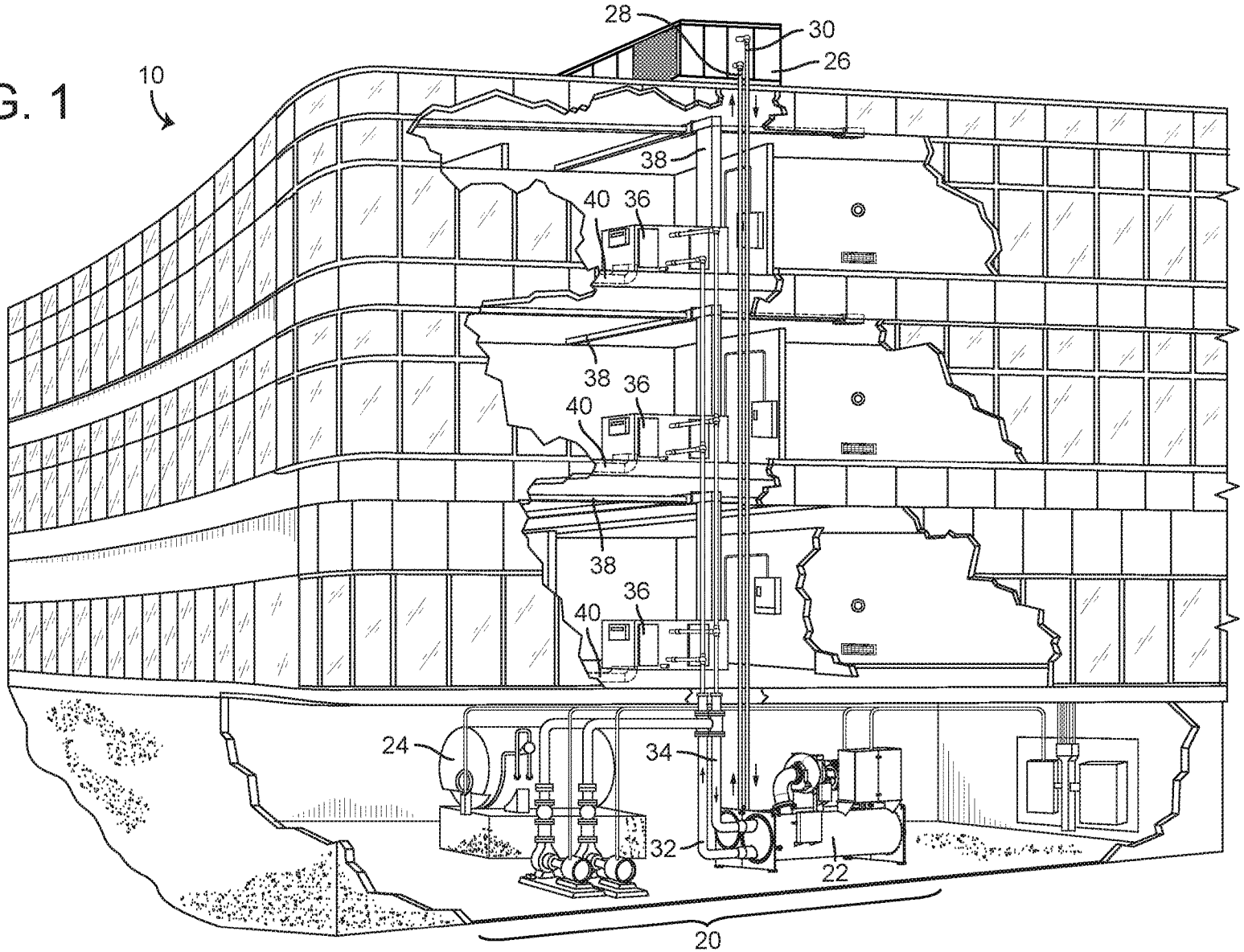
FIG. 1 a perspective view of a building serviced by a heating, ventilation, and air conditioning system (HVAC) system, according to an exemplary embodiment.

Referring now to FIG. 1, a perspective view of a building 10 is shown. Building 10 is serviced by a heating, ventilation, and air conditioning system (HVAC) system 20. HVAC system 20 is shown to include a chiller 22, a boiler 24, a rooftop cooling unit 26, and a plurality of air-handling units (AHUs) 36. HVAC system 20 uses a fluid circulation system to provide heating and/or cooling for building 10. The circulated fluid may be cooled in chiller 22 or heated in boiler 24, depending on whether cooling or heating is required. Boiler 24 may add heat to the circulated fluid by burning a combustible material (e.g., natural gas). Chiller 22 may place the circulated fluid in a heat exchange relationship with another fluid (e.g., a refrigerant) in a heat exchanger (e.g., an evaporator). The refrigerant removes heat from the circulated fluid during an evaporation process, thereby cooling the circulated fluid.

The circulated fluid from chiller 22 or boiler 24 may be transported to AHUs 36 via piping 32. AHUs 36 may place the circulated fluid in a heat exchange relationship with an airflow passing through AHUs 36. For example, the airflow may be passed over piping in fan coil units or other air conditioning terminal units through which the circulated fluid flows. AHUs 36 may transfer heat between the airflow and the circulated fluid to provide heating or cooling for the airflow. The heated or cooled air may be delivered to building 10 via an air distribution system including air supply ducts 38 and may return to AHUs 36 via air return ducts 40. HVAC system 20 is shown to include a separate AHU 36 on each floor of building 10. In other embodiments, a single AHU (e.g., a rooftop AHU) may supply air for multiple floors or zones. The circulated fluid from AHUs 36 may return chiller 22 or boiler 24 via piping 34.

In some embodiments, the refrigerant in chiller 22 is vaporized upon absorbing heat from the circulated fluid. The vapor refrigerant may be provided to a compressor within chiller 22 where the temperature and pressure of the refrigerant are increased (e.g., using a rotating impeller, a screw compressor, a scroll compressor, a reciprocating compressor, a centrifugal compressor, etc.). The compressed refrigerant may be discharged into a condenser within chiller 22. In some embodiments, water (or another fluid) flows through tubes in the condenser of chiller 22 to absorb heat from the refrigerant vapor, thereby causing the refrigerant to condense. The water flowing through tubes in the condenser may be pumped from chiller 22 to a cooling unit 26 via piping 28. Cooling unit 26 may use fan driven cooling or fan driven evaporation to remove heat from the water. The cooled water from cooling unit 26 may be delivered back to chiller 22 via piping 30 and the cycle repeats.

Figure 2:
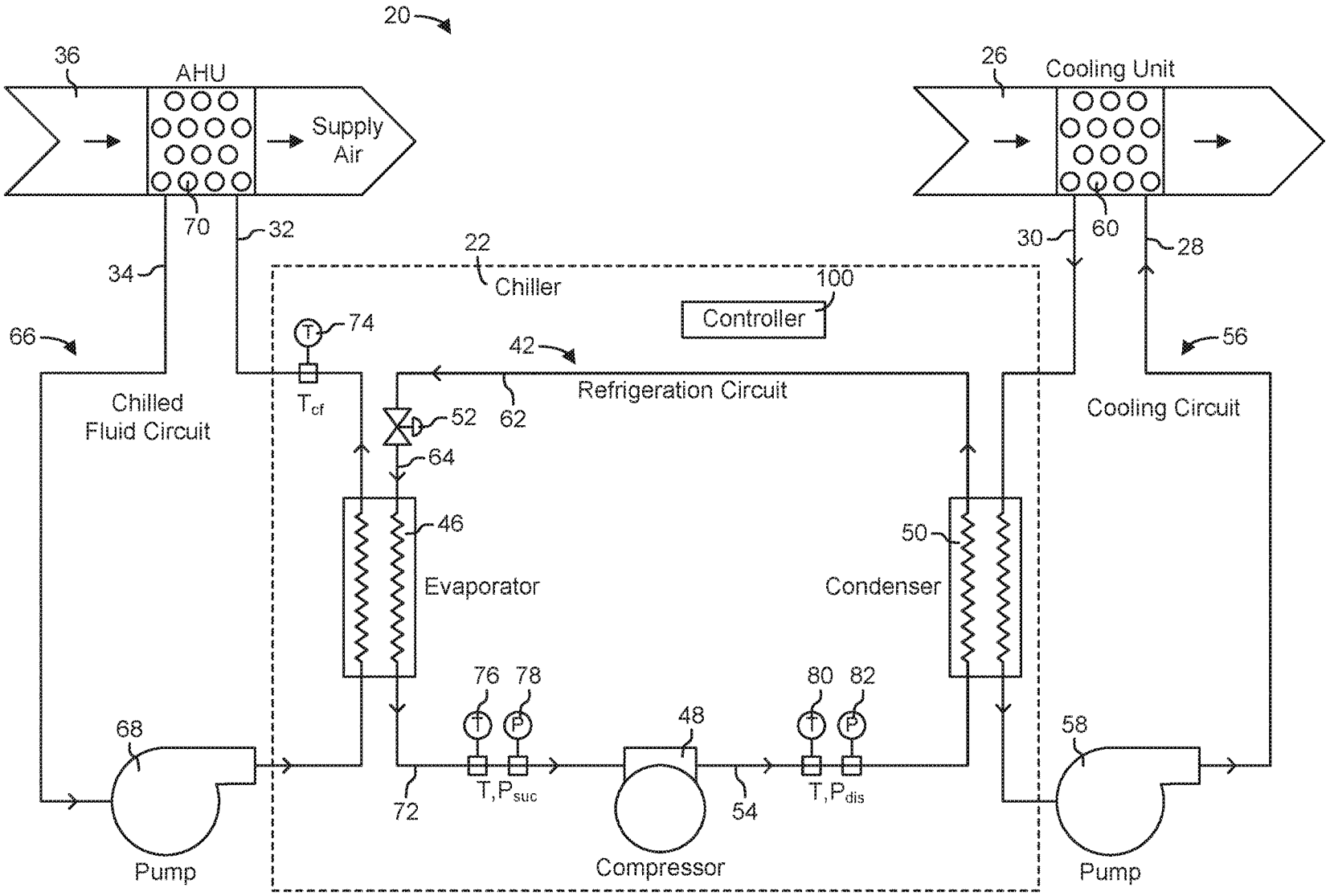
FIG. 2 is a block diagram illustrating a portion of the HVAC system of FIG. 1 in greater detail, showing a refrigeration circuit configured to circulate a refrigerant between an evaporator and a condenser, according to an exemplary embodiment.

Referring now to FIG. 2, a block diagram illustrating a portion of HVAC system 20 in greater detail is shown, according to an exemplary embodiment. In FIG. 2, chiller 22 is shown to include a refrigeration circuit 42 and a controller 100. Refrigeration circuit 42 is shown to include an evaporator 46, a compressor 48, a condenser 50, and an expansion valve 52. Compressor 48 may be configured to circulate a refrigerant through refrigeration circuit 42. In some embodiments, compressor 48 is operated by controller 100. Compressor 48 may compress the refrigerant to a high pressure, high temperature state and discharge the compressed refrigerant into a compressor discharge line 54 connecting the outlet of compressor 48 to the inlet of condenser 50. According to an exemplary embodiment, compressor 48 is a screw compressor. In some embodiments, compressor 48 is a semi-hermetic screw compressor. In other embodiments, compressor 48 is a hermitic or open screw compressor. In alternative embodiments, compressor 48 is a scroll compressor, a reciprocating compressor, a centrifugal compressor, or still another type of compressor.

Condenser 50 may receive the compressed refrigerant from compressor discharge line 54. Condenser 50 may also receive a separate heat exchange fluid from cooling circuit 56 (e.g., water, a water-glycol mixture, another refrigerant, etc.). Condenser 50 may be configured to transfer heat from the compressed refrigerant to the heat exchange fluid, thereby causing the compressed refrigerant to condense from a gaseous refrigerant to a liquid or mixed fluid state. In some embodiments, cooling circuit 56 is a heat recovery circuit configured to use the heat absorbed from the refrigerant for heating applications. In other embodiments, cooling circuit 56 includes a pump 58 for circulating the heat exchange fluid between condenser 50 and cooling unit 26. Cooling unit 26 may include cooling coils 60 configured to facilitate heat transfer between the heat exchange fluid and another fluid (e.g., air) flowing through cooling unit 26. In other embodiments, cooling unit 26 may be a cooling tower. The heat exchange fluid may reject heat in cooling unit 26 and return to condenser 50 via piping 30.

Still referring to FIG. 2, refrigeration circuit 42 is shown to include a line 62 connecting an outlet of condenser 50 to an inlet of expansion device 52. Expansion device 52 may be configured to expand the refrigerant in refrigeration circuit 42 to a low temperature and low pressure state. Expansion device 52 may be a fixed position device or variable position device (e.g., a valve). Expansion device 52 may be actuated manually or automatically (e.g., by controller 100 via a valve actuator) to adjust the expansion of the refrigerant passing therethrough. Expansion device 52 may output the expanded refrigerant into line 64 connecting an outlet of expansion device 52 to an inlet of evaporator 46.

Evaporator 46 may receive the expanded refrigerant from line 64. Evaporator 46 may also receive a separate chilled fluid from chilled fluid circuit 66 (e.g., water, a water-glycol mixture, another refrigerant, etc.). Evaporator 46 may be configured to transfer heat from the chilled fluid to the expanded refrigerant in refrigeration circuit 42, thereby cooling the chilled fluid and causing the refrigerant to evaporate. In some embodiments, chilled fluid circuit 66 includes a pump 68 for circulating the chilled fluid between evaporator 46 and AHU 36. AHU 36 may include cooling coils 70 configured to facilitate heat transfer between the chilled fluid and another fluid (e.g., air) flowing through AHU 36. The chilled fluid may absorb heat in AHU 36 and return to evaporator 46 via piping 34. Evaporator 46 may output the heated refrigerant to compressor suction line 72 connecting the outlet of evaporator 46 with the inlet of compressor 48.

As shown in FIG. 2, chilled fluid circuit 66 includes a chilled fluid temperature sensor 74 positioned along piping 32. Chilled fluid temperature sensor 74 may be configured to measure a temperature $T_{cf}$ of the chilled fluid (e.g., the leaving chilled liquid temperature, etc.) flowing within piping 32 between evaporator 46 and AHU 36. As shown in FIG. 2, refrigeration circuit 42 includes a suction temperature sensor 76 positioned along compressor suction line 72. Suction temperature sensor 76 may be configured to measure a temperature $T_{suc}$ of the refrigerant flowing within compressor suction line 72 between evaporator 46 and compressor 48 (i.e., the temperature of the refrigerant entering compressor 48). As shown in FIG. 2, refrigeration circuit 42 includes a suction pressure sensor 78 positioned along compressor suction line 72. Suction pressure sensor 78 may be configured to measure a pressure $P_{suc}$ of the refrigerant flowing within compressor suction line 72 between evaporator 46 and compressor 48 (i.e., the pressure of the refrigerant entering compressor 48). As shown in FIG. 2, refrigeration circuit 42 includes a discharge temperature sensor 80 positioned along compressor discharge line 54. Discharge temperature sensor 80 may be configured to measure a temperature $T_{dis}$ of the refrigerant flowing within compressor discharge line 54 between compressor 48 and condenser 50 (i.e., the temperature of the refrigerant exiting compressor 48). As shown in FIG. 2, refrigeration circuit 42 includes a discharge pressure sensor 82 positioned along compressor discharge line 54. Discharge pressure sensor 82 may be configured to measure a pressure $P_{dis}$ of the refrigerant flowing within compressor discharge line 54 between compressor 48 and condenser 50 (i.e., the pressure of the refrigerant exiting compressor 48).

Figure 3:
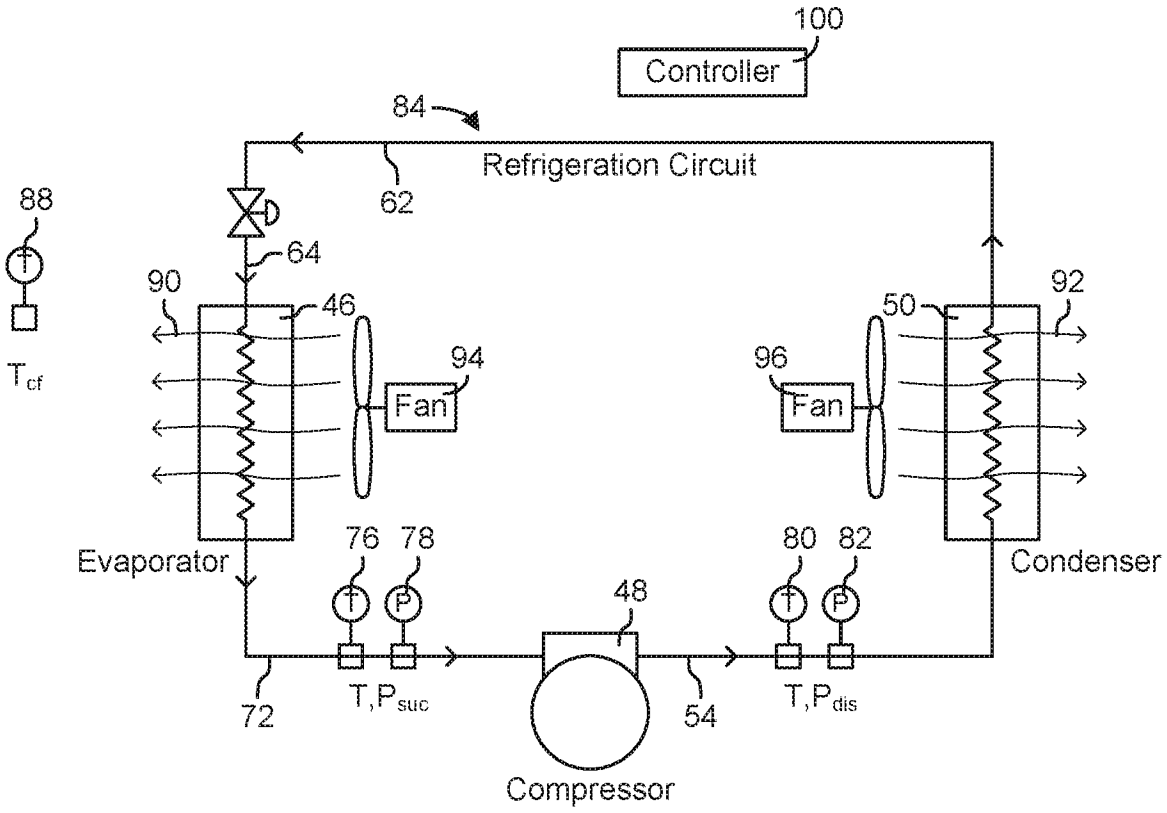
FIG. 3 is a block diagram illustrating an alternative implementation of the refrigeration circuit of FIG. 2, according to an exemplary embodiment.

Referring now to FIG. 3, a refrigeration circuit 84 is shown, according to another exemplary embodiment. Refrigeration circuit 84 may be the same or similar to refrigeration circuit 42 as described with reference to FIG. 2, but implemented in a more general setting. For example, refrigeration circuit 84 is shown to include evaporator 46, compressor 48, condenser 50, expansion device 52, compressor discharge line 54, line 62, line 64, compressor suction line 72, suction temperature sensor 76 and suction pressure sensor 78 positioned along compressor suction line 72, and discharge temperature sensor 80 and discharge pressure sensor 82 positioned along compressor discharge line 54. Refrigeration circuit 84 may be implemented in a chiller (e.g., chiller 22) or used in a various other refrigeration systems or devices such as refrigerators, freezers, refrigerated display cases, refrigerated storage devices, product coolers, standalone air conditioners, or any other system or device that provides cooling using a vapor-compression refrigeration loop.

In refrigeration circuit 84, evaporator 46 is shown absorbing heat from an airflow 90 forced through or across evaporator 46 by a fan 94. Similarly, condenser 50 is shown rejecting heat to an airflow 92 forced through or across condenser 50 by a fan 96. Fan 94 and fan 96 may be controlled by controller 100 to modulate the rate of heat transfer in evaporator 46 and/or condenser 50, respectively. In some embodiments, fan 94 and/or fan 96 are variable speed fans capable of operating at multiple different speeds. Controller 100 may increase or decrease the speed of fan 94 and/or fan 96 in response to various inputs from refrigeration circuit 84 (e.g., temperature measurements, pressure measurements, etc.).

Refrigeration circuit 84 is shown to include a chilled fluid temperature sensor 88 positioned within airflow 90 downstream of evaporator 46. Chilled fluid temperature sensor 88 may be configured to measure the temperature of airflow 90 after airflow 90 is chilled by evaporator 46. Controller 100 may be configured to control operation of compressor 48 at least partially based on measurement inputs received from at least one of chilled fluid temperature sensor 88, suction temperature sensor 76, suction pressure sensor 78, discharge temperature sensor 80, and discharge pressure sensor 82. In other embodiments, refrigeration circuit 84 exchanges heat with one or more closed fluid circuits (e.g., chilled fluid circuit 66, cooling circuit 56, etc.) as described with reference to FIG. 2. In such embodiments, controller 100 may receive a measurement of a chilled fluid temperature.

Controller 100 may receive measurement inputs from at least one of chilled fluid temperature sensor 74 or chilled fluid temperature sensor 88, suction temperature sensor 76, suction pressure sensor 78, discharge temperature sensor 80, and discharge pressure sensor 82. Controller 100 may be configured to control operation of compressor 48 (e.g., a slide valve thereof, etc.) at least partially based on the measurement inputs received from at least one of chilled fluid temperature sensor 74 or chilled fluid temperature sensor 88, suction temperature sensor 76, suction pressure sensor 78, discharge temperature sensor 80, and discharge pressure sensor 82. Controller 100 may be an embedded controller for chiller 22 configured to control the components of refrigeration circuit 42 and/or refrigeration circuit 84. For example, controller 100 may be configured to activate/deactivate compressor 48 and open/close expansion device 52. Controller 100 may be configured to determine thermodynamic properties of the refrigerant at various locations within refrigeration circuit 42 and/or refrigeration circuit 84 based on the measurement inputs from at least one of chilled fluid temperature sensor 74 or chilled fluid temperature sensor 88, suction temperature sensor 76, suction pressure sensor 78, discharge temperature sensor 80, and discharge pressure sensor 82. For example, controller 100 may calculate non-measured thermodynamic properties (e.g., enthalpy, entropy, etc.) of the refrigerant in compressor suction line 72, compressor discharge line 54, and/or other locations within refrigeration circuit 42.

Figure 4:
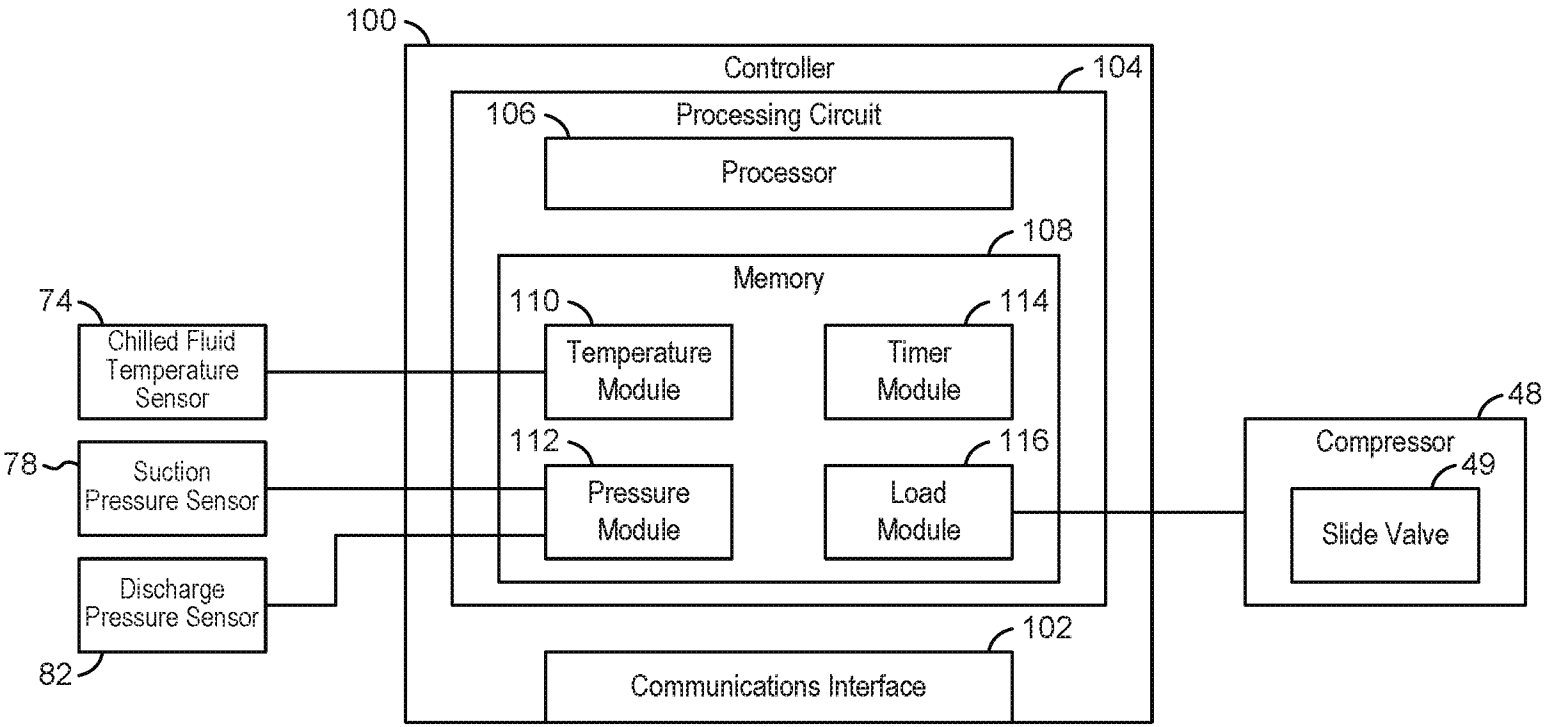
FIG. 4 is a block diagram of a compressor control system, according to an exemplary embodiment.

Referring now to FIG. 4, a block diagram of a compressor control system including the controller 100 is shown, according to an exemplary embodiment. According to the exemplary embodiment shown in FIG. 4, compressor 48 is configured as a screw compressor having a slide valve, shown as slide valve 49. Slide valve 49 may be selectively actuated to modulate (e.g., increase, decrease, load, unload, etc.) the capacity of compressor 48. Controller 100 is configured to selectively actuate slide valve 49 without receiving feedback regarding the current position of slide valve 49 (e.g., the current position of slide valve 49 is unknown, the current capacity of compressor 48 is unknown, etc.), according to an exemplary embodiment.

As shown in FIG. 4, controller 100 includes a communications interface 102 and a processing circuit 104. Communications interface 102 may include wired or wireless interfaces (e.g., jacks, antennas, transmitters, receivers, transceivers, wire terminals, etc.) for conducting data communications with various systems, devices, or networks. For example, communications interface 102 may include an Ethernet card and/or port for sending and receiving data via an Ethernet-based communications network. In some embodiments, communications interface 102 includes a wireless transceiver (e.g., a WiFi transceiver, a Bluetooth transceiver, a NFC transceiver, ZigBee, etc.) for communicating via a wireless communications network. Communications interface 102 may be configured to communicate via local area networks (e.g., a building LAN, etc.) and/or wide area networks (e.g., the Internet, a cellular network, a radio communication network, etc.) and may use a variety of communications protocols (e.g., BACnet, TCP/IP, point-to-point, etc.).

In some embodiments, communications interface 102 is configured to facilitate receiving measurement inputs from various sensors. The sensors may include, for example, chilled fluid temperature sensor 74 configured to measure the temperature of the chilled fluid at an outlet of evaporator 46, suction pressure sensor 78 configured to measure the pressure of the refrigerant in compressor suction line 72, discharge pressure sensor 82 configured to measure the pressure of the refrigerant in compressor discharge line 54, and/or other sensors of chiller 22 and/or HVAC system 20 (e.g., suction temperature sensor 76, discharge temperature sensor 80, chilled fluid temperature sensor 88, etc.). Communications interface 102 may receive the measurement inputs directly from the sensors, via a local network, and/or via a remote communications network. Communications interface 102 may enable communications between controller 100 and compressor 48. In some embodiments, communications interface 102 is configured to facilitate transmitting load and unload commands to slide valve 49 of compressor 48 and/or receiving load/unload timer information regarding loading/unloading of compressor 48.

As shown in FIG. 4, processing circuit 104 includes a processor 106 and memory 108. Processor 106 may be a general purpose or specific purpose processor, an application specific integrated circuit (ASIC), one or more field programmable gate arrays (FPGAs), a group of processing components, or other suitable processing components. Processor 106 may be configured to execute computer code or instructions stored in memory 108 (e.g., fuzzy logic, etc.) or received from other computer readable media (e.g., CDROM, network storage, a remote server, etc.) to perform one or more of the processes described herein.

Memory 108 may include one or more data storage devices (e.g., memory units, memory devices, computer-readable storage media, etc.) configured to store data, computer code, executable instructions, or other forms of computer-readable information. Memory 108 may include random access memory (RAM), read-only memory (ROM), hard drive storage, temporary storage, non-volatile memory, flash memory, optical memory, or any other suitable memory for storing software objects and/or computer instructions. Memory 108 may include database components, object code components, script components, or any other type of information structure for supporting the various activities and information structures described in the present disclosure. Memory 108 may be communicably connected to processor 106 via processing circuit 104 and may include computer code for executing (e.g., by processor 106) one or more of the processes described herein.

As shown in FIG. 4, memory 108 includes various modules for completing processes described herein. More particularly, memory 108 includes a temperature module 110, a pressure module 112, a timer module 114, and a load module 116. While various modules with particular functionality are shown in FIG. 4, it should be understood that controller 100 and memory 108 may include any number of modules for completing the functions described herein. For example, the activities of multiple modules may be combined as a single module and additional modules with additional functionality may be included. Further, it should be understood that the controller 100 may further control other processes beyond the scope of the present disclosure.

As shown in FIG. 4, temperature module 110 is coupled to (e.g., in data receiving communication with, etc.) chilled fluid temperature sensor 74. Temperature module 110 may be configured to receive temperature data from chilled fluid temperature sensor 74. The temperature data may be indicative of the temperature $T_{cf}$ of the chilled fluid (e.g., the leaving chilled liquid temperature, etc.) flowing within piping 32 between evaporator 46 and AHU 36. In some embodiments, temperature module 110 is configured to receive and store a chilled fluid temperature setpoint (e.g., a leaving chilled liquid setpoint, etc.). The chilled fluid temperature setpoint may be predefined and stored within memory 108 during manufacture, entered via an operator of HVAC system 20 (e.g., via a user interface device, etc.), and/or based on a desired room temperature (e.g., entered by occupants of building 10 using a thermostat, etc.). The chilled fluid temperature setpoint may indicate a desired temperature $T_{cf}$ for the chilled fluid flowing within piping 32 from evaporator 46 to AHU 36 (e.g., to perform a desired cooling operation to provide a desired conditioned air temperature within building 10, etc.). Temperature module 110 may be further configured to compare the temperature $T_{cf}$ of the chilled fluid to the chilled fluid temperature setpoint to determine a difference between the temperature $T_{cf}$ of the chilled fluid and the chilled fluid temperature setpoint. The difference between the temperature $T_{cf}$ of the chilled fluid and the chilled fluid temperature setpoint may be used by load module 116 when controlling slide valve 49 and/or compressor 48.

As shown in FIG. 4, pressure module 112 is coupled to (e.g., in data receiving communication with, etc.) suction pressure sensor 78. Pressure module 112 may be configured to receive first pressure data from suction pressure sensor 78. The first pressure data may be indicative of the pressure $P_{suc}$ of the refrigerant flowing within compressor suction line 72 into the inlet of compressor 48. As shown in FIG. 4, pressure module 112 is coupled to (e.g., in data receiving communication with, etc.) discharge pressure sensor 82. Pressure module 112 may be configured to receive second pressure data from discharge pressure sensor 82. The second pressure data may be indicative of the pressure $P_{dis}$ of the refrigerant flowing out of the outlet of compressor 48 within compressor discharge line 54. The pressure $P_{suc}$ and/or the pressure $P_{dis}$ may be used by load module 116 when controlling slide valve 49 and/or compressor 48.

Timer module 114 may be configured to initiate and/or continue a load timer each time compressor 48 receives a load command, as described further herein. The timer module 114 may be configured to initiate and/or continue an unload timer each time compressor 48 receives an unload command, as described further herein. The load timer and/or the unload timer may be used to estimate the current position of slide valve 49 as controller 100 modulates the capacity of compressor 48. By way of example, slide valve 49 may take a first amount of time to reach (e.g., actuate into, stroke into, etc.) a fully-loaded position (e.g., from a nominal/neutral position, from a fully-unloaded position, etc.) such that compressor 48 operates at maximum capacity. By way of another example, slide valve 49 may take a second amount of time to reach (e.g., actuate into, stroke into, etc.) a fully-unloaded position (e.g., from a nominal/neutral position, from the fully-loaded position, etc.) such that compressor 48 operates at minimum capacity. The load timer and the unload timer may be a single timer that counts positive time while compressor 48 is being loaded and negative time when the compressor 48 is being unloaded (e.g., zero time may represent a neutral, nominal, half-way position of slide valve 49; zero or a minimum threshold may represent a fully-unloaded position; a maximum threshold may represent a fully-loaded position; etc.). The load timer and/or the unload timer may be used by load module 116 when controlling slide valve 49 and/or compressor 48.

In some embodiments, the first amount of time for slide valve 49 to reach the fully-loaded position is greater than (e.g., takes a greater amount of time, etc.) than the second amount of time for slide valve 49 to reach the fully-unloaded position (e.g., slide valve 49 is spring biased towards the fully-unloaded position, etc.). In other embodiments, the second amount of time for slide valve 49 to reach the fully-unloaded position is greater than (e.g., takes a greater amount of time, etc.) than the first amount of time for slide valve 49 to reach the fully-loaded position (e.g., slide valve 49 is spring biased towards the fully-loaded position, etc.). In still other embodiments, the first amount of time for slide valve 49 to reach the fully-loaded position and the second amount of time for slide valve 49 to reach the fully-unloaded position are the same.

As shown in FIG. 4, load module 116 is coupled to (e.g., in data receiving and/or command transmitting communication with, etc.) compressor 48 and/or slide valve 49 thereof. Load module 116 may be configured to transmit a load command and/or an unload command to slide valve 49 of compressor 48 based on at least one of (i) the difference between the temperature $T_{cf}$ of the chilled fluid and the chilled fluid temperature setpoint, (ii) the pressure $P_{suc}$, (iii) the pressure $P_{dis}$, (iv) the load timer, and (iv) the unload timer.

According to an exemplary embodiment, load module 116 is configured to provide a load command to slide valve 49 (e.g., increasing the size of the inlet of compressor 48, etc.) to increase the capacity of compressor 48 in response to the temperature $T_{cf}$ of the chilled fluid within piping 32 being greater than the chilled fluid temperature setpoint. By way of example, increasing the capacity of compressor 48 may facilitate compressor 48 in increasing the circulation (e.g., flow rate, mass flow rate, volume flow rate, etc.) of the refrigerant through the refrigeration circuit 42. (or refrigeration circuit 84). Increasing the circulation of the refrigerant may increase the amount of heat removed from the fluid of chilled fluid circuit 66 flowing through evaporator 46, thereby reducing the temperature $T_{cf}$ of the chilled fluid.

In some embodiments, load module 116 is configured to continue providing the load command until at least one of (i) the temperature $T_{cf}$ of the chilled fluid decreases such that the temperature $T_{cf}$ is equal to or approximately equal to (e.g., within a predetermined range of, etc.) the chilled fluid temperature setpoint and (ii) the load timer reaches a load time threshold. By way of example, load module 116 may be configured to stop providing the load command to slide valve 49 and stop the load timer in response to the temperature $T_{cf}$ of the chilled fluid decreasing such that the temperature $T_{cf}$ is equal to or approximately equal to the chilled fluid temperature setpoint (e.g., the capacity of compressor 48 does not need to be increased further to provide the chilled fluid at the chilled fluid temperature setpoint, etc.).

By way of another example, load module 116 may be configured to stop the load timer and continue providing the load command for a predetermined amount of time (e.g., five seconds, thirty seconds, one minute, etc.) in response to the load timer reaching the load time threshold indicating that compressor 48 is fully-loaded (e.g., slide valve 49 is positioned in a fully-open position, etc.). The load time threshold (e.g., the elapsed time for slide valve 49 to move or stroke from a fully-closed position to a fully-open position, etc.) may be predefined and stored within load module 116 based on design characteristics of compressor 48 and/or slide valve 49. Load module 116 may be configured to stop providing the load command to slide valve 49 after the predetermined amount of time has elapsed, but compressor 48 may continue to operate at full-load (e.g., as long as the temperature $T_{cf}$ of the chilled fluid has not yet decreased such that the temperature $T_{cf}$ is equal to or approximately equal to the chilled fluid temperature setpoint, slide valve 49 remains positioned in the fully-open position, etc.). According to an exemplary embodiment, load module 116 continues to provide the load command for the predetermined amount of time after the load timer reaches the load time threshold to prevent and/or reduce potential drift of slide valve 49 and/or the capacity of compressor 48.

In some embodiments, load module 116 is configured to determine a load limit for compressor 48 based on the pressure $P_{suc}$ of the refrigerant entering compressor 48 and the pressure $P_{dis}$ of the refrigerant exiting compressor 48. Load module 116 may be configured to provide the load command to slide valve 49 in such a way that operation of compressor 48 (e.g., operating characteristics thereof, etc.) does not exceed the load limit (e.g., the load command is stopped in response to the load limit being reached, etc.). Limiting the operation of compressor 48 within the load limit may prevent tripping a fault threshold. The fault threshold may be configured to shut compressor 48 down and/or limit operation thereof in response to operating conditions becoming too extreme (e.g., to protect compressor 48 and/or other components of chiller 22, etc.).

According to an exemplary embodiment, load module 116 is configured to provide an unload command to slide valve 49 (e.g., reducing the size of the inlet of compressor 48, etc.) to decrease the capacity of compressor 48 in response to the temperature $T_{cf}$ of the chilled fluid within piping 32 being less than the chilled fluid temperature setpoint. By way of example, decreasing the capacity of compressor 48 may facilitate compressor 48 in decreasing the circulation (e.g., flow rate, mass flow rate, volume flow rate, etc.) of the refrigerant through the refrigeration circuit 42 (or refrigeration circuit 84). Decreasing the circulation of the refrigerant may decrease the amount of heat removed from the fluid of chilled fluid circuit 66 flowing through evaporator 46, thereby increasing the temperature $T_{cf}$ of the chilled fluid.

In some embodiments, load module 116 is configured to continue providing the unload command until at least one of (i) the temperature $T_{cf}$ of the chilled fluid increases such that the temperature $T_{cf}$ is equal to or approximately equal to (e.g., within a predetermined range of, etc.) the chilled fluid temperature setpoint and (ii) the unload timer reaches an unload time threshold. By way of example, load module 116 may be configured to stop providing the unload command to slide valve 49 and stop the unload timer in response to the temperature $T_{cf}$ of the chilled fluid increasing such that the temperature $T_{cf}$ is equal to or approximately equal to the chilled fluid temperature setpoint (e.g., the capacity of compressor 48 does not need to be decreased further to provide the chilled fluid at the chilled fluid temperature setpoint, etc.).

By way of another example, load module 116 may be configured to stop the unload timer, stop providing the unload command, and take compressor 48 offline in response to the unload timer reaching the unload time threshold indicating that compressor 48 is fully-unloaded (e.g., slide valve 49 is positioned in the fully-closed position, etc.). The unload time threshold (e.g., the elapsed time for slide valve 49 to move or stroke from the fully-open position to the fully-closed position, etc.) may be predefined and stored within load module 116 based on design characteristics of compressor 48 and/or slide valve 49. According to an exemplary embodiment, load module 116 takes compressor 48 offline after the unload timer reaches the unload time threshold to conserve energy and since compressor 48 may not circulate the refrigerant when full-unloaded. Load module 116 may bring compressor 48 back online and provide the load command once the temperature $T_{cf}$ of the chilled fluid exceeds the chilled fluid temperature setpoint.

Figure 5:
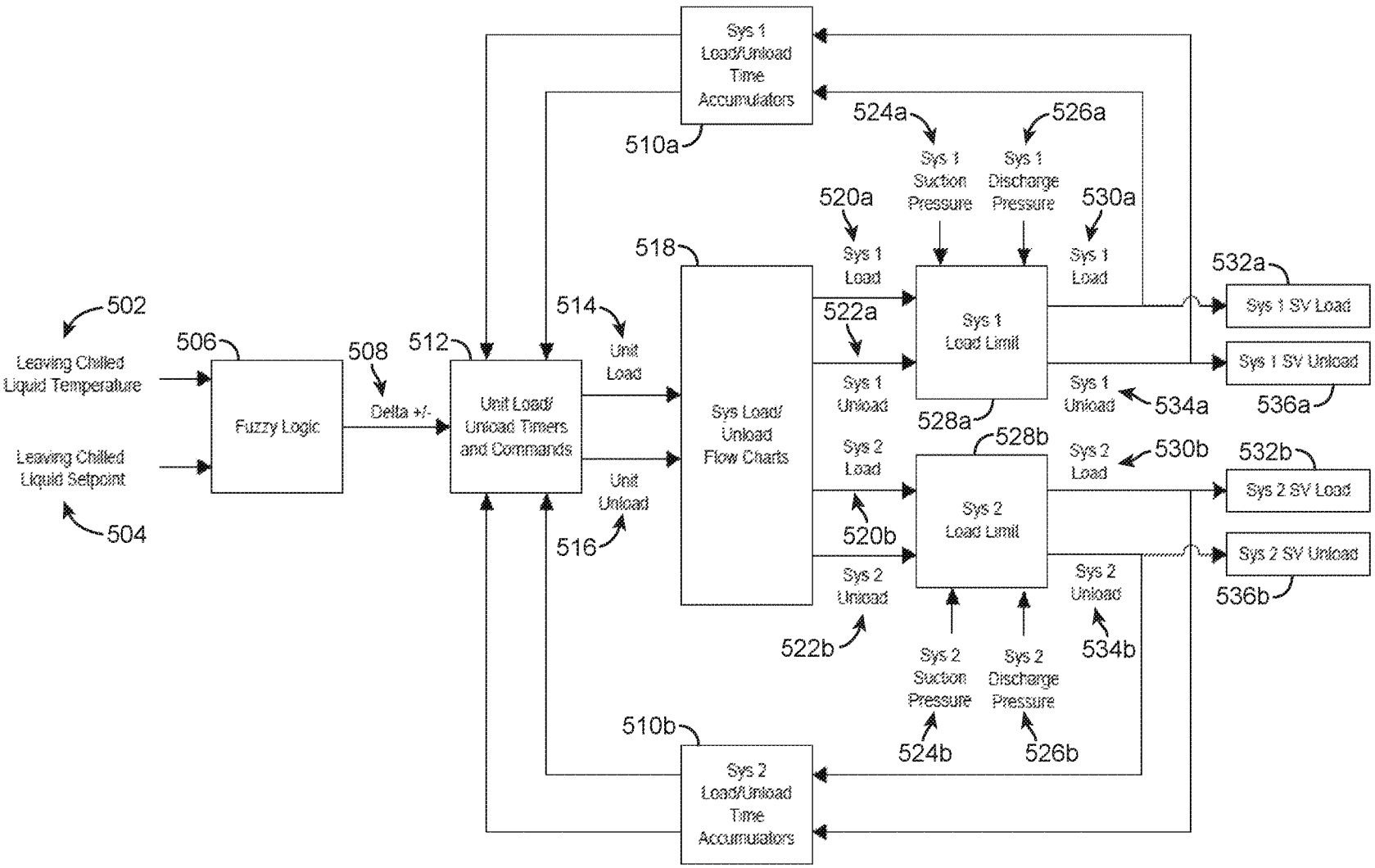
FIG. 5 is a block diagram of control logic for a compressor control system, according to an exemplary embodiment.

Referring now to FIG. 5, a block diagram of control logic for a compressor control system is shown, according to an exemplary embodiment. According to the exemplary embodiment shown in FIG. 5, the unit (e.g., HVAC system 20, etc.) includes two systems (e.g., two compressor systems, etc.). In other embodiments, the unit includes more or fewer systems (e.g., one compressor system, three compressor systems, etc.). At process 502, a leaving chilled liquid temperature is received (e.g., by controller 100, from chilled fluid temperature sensor 74, etc.). At process 504, a leaving chilled liquid setpoint is received (e.g., by controller 100, from an operator, predefined in memory 108, etc.). At process 506, the leaving chilled liquid temperature and the leaving chilled liquid setpoint are compared (e.g., by controller 100, using fuzzy logic, etc.). At process 508, a difference between the leaving chilled liquid temperature and the leaving chilled liquid setpoint is determined (e.g., by controller 100, etc.

At process 510*a*, a first load/unload time accumulator sends a first timer signal (e.g., to controller 100, etc.) regarding loading time and/or unloading time of a first compressor (e.g., a first compressor 48, etc.) of a first system. At process 510*b*, a second load/unload time accumulator sends a second timer signal regarding loading time and/or unloading time of a second compressor (e.g., a second compressor 48, etc.) of a second system. At process 512, the difference between the leaving chilled liquid temperature and the leaving chilled liquid setpoint, the first timer signal, and/or the second timer signal are interpreted (e.g., analyzed, by controller 100, etc.). At process 514 and process 516, at least one of a unit load command and a unit unload command are provided (e.g., to a system controller, a subcomponent of controller 100, load module 116, etc.). At process 518, the at least one of the unit load command and the unit unload command are received and interpreted (e.g., by the system controller, etc.).

At process 520*a* and 522*a*, a first system load command and/or a first system unload command are provided to the first system based on the unit load command and/or the unit unload command. At process 524*a* and 526*a*, a first suction pressure and a first discharge pressure are received (e.g., from suction pressure sensor 78 and discharge pressure sensor 82, etc.). At process 528*a*, a first load limit is determined for the first system based on the first suction pressure and the first discharge pressure and compared to the first system load command and/or the first system unload command. At process 530*a*, the first system load command is provided to a first slide valve (e.g., slide valve 49, etc.) of the first compressor and the first load time accumulator begins/continues a first load timer. At process 532*a*, the first slide valve performs an action (e.g., repositions, moves towards a fully-open position, etc.) according to the first system load command to increase the capacity of the first compressor. At process 534*a*, the first system unload command is provided to the first slide valve of the first compressor and the first unload time accumulator begins/continues a first unload timer. At process 536*a*, the first slide valve performs an action (e.g., repositions, moves towards a fully-closed position, etc.) according to the first system unload command to decrease the capacity of the first compressor.

At process 520*b* and 522*b*, a second system load command and/or a second system unload command are provided to the second system based on the unit load command and/or the unit unload command. At process 524*b* and 526*b*, a second suction pressure and a second discharge pressure are received (e.g., from suction pressure sensor 78 and discharge pressure sensor 82, etc.). At process 528*b*, a second load limit is determined for the second system based on the second suction pressure and the second discharge pressure and compared to the second system load command and/or the second system unload command. At process 530*b*, the second system load command is provided to a second slide valve (e.g., slide valve 49, etc.) of the second compressor and the second load time accumulator begins/continues a second load timer. At process 532*b*, the second slide valve performs an action (e.g., repositions, moves towards a fully-open position, etc.) according to the second system load command to increase the capacity of the second compressor. At process 534*b*, the second system unload command is provided to the second slide valve of the second compressor and the second unload time accumulator begins/continues a second unload timer. At process 536*b*, the second slide valve performs an action (e.g., repositions, moves towards a fully-closed position, etc.) according to the second system unload command to decrease the capacity of the second compressor.

Figure 6:
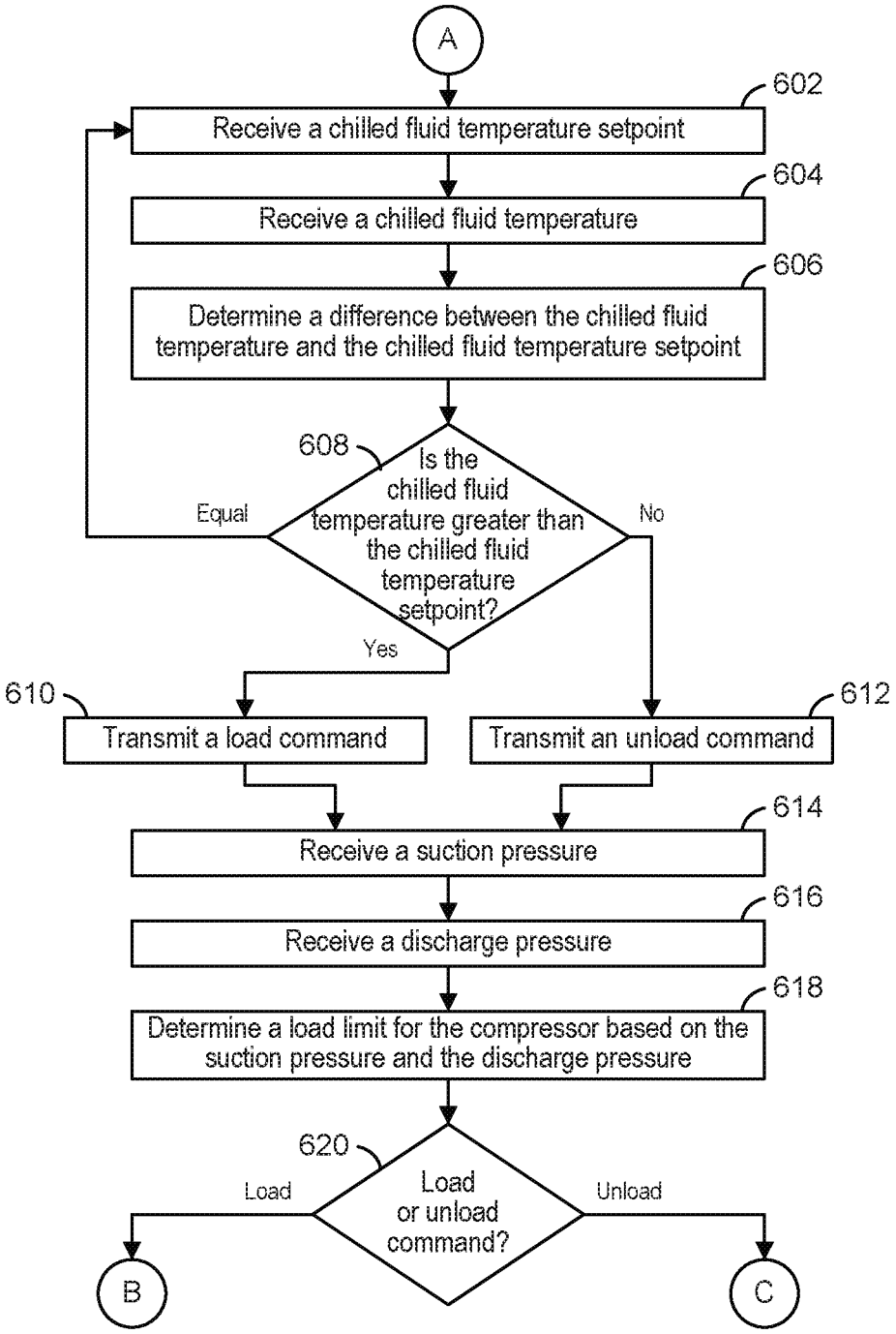
FIG. 6 is a flow diagram of a method for capacity control of chillers having screw compressors, according to an exemplary embodiment.
Figure 6:
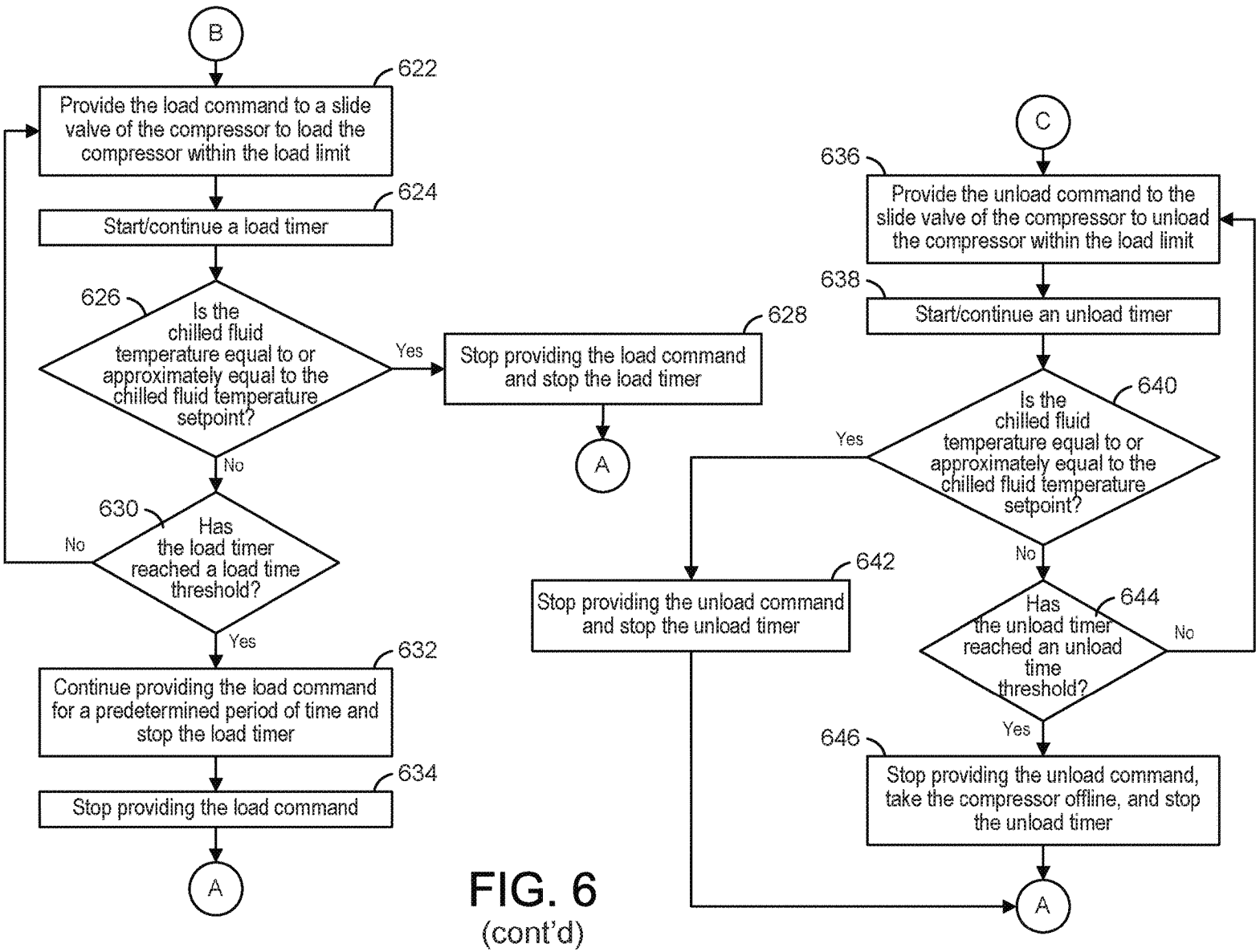

Referring now to FIG. 6, a method 600 for capacity control of chillers having screw compressors where a position of a slide valve thereof is unknown (e.g., not directly known, etc.) is shown, according to an exemplary embodiment. At step 602, a controller (e.g., the controller 100, etc.) is configured to receive a chilled fluid temperature setpoint. In some embodiments, the chilled fluid temperature setpoint is predefined and stored within the controller during manufacture. In some embodiments, the chilled fluid temperature setpoint is entered by an operator. In some embodiments, the chilled fluid temperature setpoint is determined by the controller based on a desired temperature entered by an occupant of a building/room (e.g., via a thermostat, etc.). The chilled fluid temperature setpoint may indicate a desired temperature for a chilled fluid flowing within a chilled fluid circuit (e.g., chilled fluid circuit 66, etc.) in thermal communication with a refrigerant of a refrigeration circuit (e.g., refrigeration circuit 42, through evaporator 46, etc.) of the chiller (e.g., chiller 22, etc.) having a screw compressor (e.g., compressor 48, etc.). The chilled fluid may be provided to an AHU (e.g., AHU 36, etc.) to perform a desired cooling operation to provide a desired conditioned air temperature within a building/room.

At step 604, the controller is configured to receive temperature data indicative of a chilled fluid temperature of the chilled fluid of the chilled fluid circuit from a temperature sensor (e.g., chilled fluid temperature sensor 74, etc.). At step 606, the controller is configured to determine a difference between the chilled fluid temperature and the chilled fluid temperature setpoint. At step 608, the controller is configured to determine whether the chilled fluid temperature is greater than the chilled fluid temperature setpoint. The controller is configured to return to step 602 in response to the chilled fluid temperature being equal to or approximately equal to (e.g., within a predefined range of, etc.) the chilled fluid temperature setpoint (i.e., the capacity of the screw compressor does not need to be adjusted as the temperature of the chilled fluid is at or near the setpoint).

At step 610, the controller is configured to transmit a load command to the screw compressor in response to the chilled fluid temperature being greater than the chilled fluid temperature setpoint (e.g., to increase the capacity of the screw compressor to thereby decrease the temperature of the chilled fluid, etc.). At step 612, the controller is configured to transmit an unload command to the screw compressor in response to the chilled fluid temperature being less than the chilled fluid temperature setpoint (e.g., to decrease the capacity of the screw compressor to thereby increase the temperature of the chilled fluid, etc.).

At step 614, the controller is configured to receive first pressure data indicative of a suction pressure of the refrigerant entering the screw compressor from a first pressure sensor (e.g., suction pressure sensor 78, etc.). At step 616, the controller is configured to receive second pressure data indicative of a discharge pressure of the refrigerant exiting the screw compressor from a second pressure sensor (e.g., discharge pressure sensor 82, etc.). At step 618, the controller is configured to determine a load limit of the screw compressor based on the suction pressure and the discharge pressure of the refrigerant. At step 620, the controller is configured to operate a load control scheme (steps 622-634) if the load command was transmitted to the screw compressor or operate a unload control scheme (steps 636-646) if the unload command was transmitted to the screw compressor.

At step 622, the controller is configured to provide the load command to a slide valve (e.g., slide valve 49, etc.) of the screw compressor to load the screw compressor (e.g., actuate the slide valve to increase the inlet opening of the screw compressor to increase the refrigerant circulation, etc.). The load command may be provided so long as the load of the screw compressor does not exceed the load limit (e.g., to prevent a fault threshold from being reached, etc.). At step 624, the controller is configured to start a load timer or continue a previously stopped load timer. At 626, the controller is configured to determine whether the chilled fluid temperature is equal to or approximately equal to the chilled fluid temperature setpoint (i.e., has the chilled fluid temperature dropped to the chilled fluid temperature setpoint since providing the load command to the slide valve). If the chilled fluid temperature is equal to or approximately equal to the chilled fluid temperature setpoint, the controller is configured to stop providing the load command to the slide valve and stop the load timer (e.g., the screw compressor continues to operate at the current state, the slide valve remains in its current position, etc.) (step 628) and may return to step 602. If the chilled fluid temperature is not equal to or approximately equal to the chilled fluid temperature setpoint, the controller is configured to proceed to step 630.

At step 630, the controller is configured to determine whether the load timer has reached a load time threshold. The load time threshold (e.g., an elapsed time for the slide valve to move or stroke from a fully-closed position to a fully-open position, etc.) may be predefined and stored within the controller based on design characteristics of the screw compressor and/or the slide valve. If the chilled temperature setpoint and the load time threshold are both not reached, the controller returns to step 622 to continue providing the load command to the slide valve until at least one of (i) the chilled fluid temperature setpoint is reached (step 626) and (ii) the load timer is reached (step 630). If the load time threshold is reached prior to the chilled fluid temperature decreasing to satisfy the chilled fluid temperature setpoint, the controller is configured to continue providing the load command for a predetermined period of time and stop the load timer (step 632). Reaching the load time threshold may indicate that the slide valve is fully-open (i.e., the screw compressor is at maximum capacity, fully-loaded). The load command may be provided after the load timer reaches the load time threshold to prevent and/or reduce potential drift of the slide valve and/or the capacity of the screw compressor. At step 634, the controller is configured to stop providing the load command to the slide valve such that the screw compressor operates at its current capacity (e.g., the maximum capacity, the load limit capacity, the fully-loaded capacity, etc.) and return to step 602.

At step 636, the controller is configured to provide the unload command to the slide valve of the screw compressor to unload the screw compressor (e.g., actuate the slide valve to decrease the inlet opening of the screw compressor to decrease the refrigerant circulation, etc.). The unload command may be provided so long as the load of the screw compressor does not exceed the load limit (e.g., to prevent a fault threshold from being reached, etc.). At step 638, the controller is configured to start an unload timer or continue a previously stopped unload timer (or subtract from the load timer). At 640, the controller is configured to determine whether the chilled fluid temperature is equal to or approximately equal to the chilled fluid temperature setpoint (i.e., has the chilled fluid temperature increased to the chilled fluid temperature setpoint since providing the unload command to the slide valve). If the chilled fluid temperature is equal to or approximately equal to the chilled fluid temperature setpoint, the controller is configured to stop providing the unload command to the slide valve and stop the unload timer (e.g., the screw compressor continues to operate at the current state, the slide valve remains in its current position, etc.) (step 642) and may return to step 602. If the chilled fluid temperature is not equal to or approximately equal to the chilled fluid temperature setpoint, the controller is configured to proceed to step 644.

At step 644, the controller is configured to determine whether the unload timer has reached an unload time threshold. The unload time threshold (e.g., an elapsed time for the slide valve to move or stroke from a fully-open position to a fully-closed position, etc.) may be predefined and stored within the controller based on design characteristics of the screw compressor and/or the slide valve. If the chilled temperature setpoint and the unload time threshold are both not reached, the controller returns to step 636 to continue providing the load command to the slide valve until at least one of (i) the chilled fluid temperature setpoint is reached (step 640) and (ii) the unload timer is reached (step 644), If the unload time threshold is reached prior to the chilled fluid temperature increasing to satisfy the chilled fluid temperature setpoint, the controller is configured to stop the unload timer, stop providing the unload command, and take the compressor offline (step 646) and return to step 602. Reaching the unload time threshold may indicate that the slide valve is fully-closed (e.g., the screw compressor is at minimum capacity, zero-load, etc.).

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A compressor system for a refrigeration circuit, comprising:

a screw compressor including a slide valve selectively actuatable between a first position and a second position to facilitate modulating a capacity of the screw compressor between fully-loaded and fully-unloaded; and a controller communicably coupled to the slide valve, the controller configured to:

receive a chilled fluid temperature setpoint for a fluid in heat transfer communication with a refrigerant of the refrigeration circuit;

receive temperature data indicative of a chilled fluid temperature of the fluid;

determine a difference between the chilled fluid temperature and the chilled fluid temperature setpoint;

provide one of a load command and an unload command to the slide valve based on the difference between the chilled fluid temperature and the chilled fluid temperature setpoint;

start a timer each time one of the load command and the unload command is provided to the slide valve, wherein the load command causes the timer to count toward a load time threshold indicating that the screw compressor is fully-loaded and the unload command causes the timer to count toward an unload time threshold indicating that the screw compressor is fully-unloaded; and estimate a current position of the slide valve based on the timer relative to a corresponding one of the load time threshold and the unload time threshold, wherein the controller does not receive feedback from the screw compressor regarding the current position of the slide valve.

2. The compressor system of claim 1, wherein the controller is further configured to:

provide the load command to the slide valve to increase the capacity of the screw compressor in response to the chilled fluid temperature being greater than the chilled fluid temperature setpoint; and stop providing the load command in response to the chilled fluid temperature decreasing to the chilled fluid temperature setpoint.

3. The compressor system of claim 1, wherein the controller is further configured to:

provide the unload command to the slide valve to decrease the capacity of the screw compressor in response to the chilled fluid temperature being less than the chilled fluid temperature setpoint; and stop providing the unload command in response to the chilled fluid temperature increasing to the chilled fluid temperature setpoint.

4. The compressor system of claim 1, wherein the controller is further configured to continue providing the load command for a predetermined amount of time and stop the timer in response to the timer reaching the load time threshold indicating that the screw compressor is fully-loaded.

5. The compressor system of claim 4, wherein the controller is further configured to stop providing the load command after the predetermined amount of time.

6. The compressor system of claim 1, wherein the controller is further configured to stop providing the unload command and stop the timer in response to the timer reaching the unload time threshold indicating that the screw compressor is fully-unloaded.

7. The compressor system of claim 6, wherein the controller is further configured to take the screw compressor offline in response to the screw compressor being fully-unloaded.

8. The compressor system of claim 1, wherein the controller is further configured to:

receive first pressure data indicative of a suction pressure of the refrigerant entering an inlet of the screw compressor;

receive second pressure data indicative of a discharge pressure of the refrigerant exiting an outlet of the screw compressor; and determine a load limit for the screw compressor based on the suction pressure and the discharge pressure.

9. The compressor system of claim 8, wherein the controller is further configured to provide at least one of the load command and the unload command within the load limit for the screw compressor.

10. A method for capacity control of a chiller having a compressor, comprising:

receiving, by a processing circuit, a chilled fluid temperature setpoint for a fluid in heat transfer communication with a refrigerant of the chiller;

receiving, by the processing circuit, temperature data from a temperature sensor indicative of a chilled fluid temperature of the fluid;

providing, by the processing circuit, a load command to a slide valve of the compressor to increase the capacity of the compressor in response to the chilled fluid temperature being greater than the chilled fluid temperature setpoint;

providing, by the processing circuit, an unload command to the slide valve to decrease the capacity of the compressor in response to the chilled fluid temperature being less than the chilled fluid temperature setpoint;

starting, by the processing circuit, a timer each time one of the load command and the unload command is provided to the slide valve, wherein the load command causes the timer to count toward a load time threshold indicating that the compressor is fully-loaded and the unload command causes the timer to count toward an unload time threshold indicating that the screw compressor is fully-unloaded; and estimating, by the processing circuit, a current position of the slide valve based on the timer relative to a corresponding one of the load time threshold and the unload time threshold, wherein the processing circuit does not receive feedback from the compressor regarding the current position of the slide valve.

11. The method of claim 10, further comprising:

continue providing, by the processing circuit, the load command for a predetermined amount of time in response to the timer reaching the load time threshold; and stopping, by the processing circuit, the timer in response to the timer reaching the load time threshold.

12. The method of claim 11, further comprising stop providing, by the processing circuit, the load command after the predetermined amount of time.

13. The method of claim 10, further comprising:

stop providing, by the processing circuit, the unload command in response to the timer reaching the unload time threshold; and stopping, by the processing circuit, the timer in response to the timer reaching the unload time threshold.

14. The method of claim 13, further comprising taking, by the processing circuit, the compressor offline in response to the compressor being fully-unloaded.

15. A chiller, comprising:

a compressor configured to provide a refrigerant throughout the chiller, the compressor having a slide valve selectively actuatable to facilitate modulating a capacity of the compressor;

a condenser positioned downstream of the compressor;

an expansion valve positioned downstream of the condenser;

an evaporator positioned downstream of the expansion valve and upstream of the compressor, the evaporator configured to subject the refrigerant to a heat exchange relationship with a fluid; and a controller configured to:

receive a temperature setpoint for the fluid in heat transfer communication with the refrigerant;

receive temperature data indicative of a temperature of the fluid;

provide a load command to the slide valve of the compressor to increase the capacity of the compressor in response to the temperature of the fluid being greater than the temperature setpoint;

provide an unload command to the slide valve to decrease the capacity of the compressor in response to the temperature of the fluid being less than the temperature setpoint;

start a timer each time one of the load command and the unload command is provided to the slide valve, wherein the load command causes the timer to count toward a load time threshold indicating that the compressor is fully-loaded and the unload command causes the timer to count toward an unload time threshold indicating that the compressor is fully-unloaded; and estimate a current position of the slide valve based on the timer relative to a corresponding one of the load time threshold and the unload time threshold, wherein the controller does not receive feedback from the compressor regarding the current position of the slide valve.

* * * * *